United States Patent [19]

Bonnabaud

[11] 4,322,047

[45] Mar. 30, 1982

[54] DEVICE FOR THE AXIAL UNCOILING OF WIRES

[76] Inventor: Marcel Bonnabaud, Petite rue de la Gare, Pouilly-sur-Charlieu (Loire), France

[21] Appl. No.: 147,287

[22] Filed: May 6, 1980

[30] Foreign Application Priority Data

May 9, 1979 [FR] France ..... 79 12507

[51] Int. Cl.[3] ..... B65H 49/00

[52] U.S. Cl. ..... 242/128; 242/147 R

[58] Field of Search ..... 242/128, 147 R, 147 M, 242/129.8; 226/195; 57/58.83, 58.86

[56] References Cited

U.S. PATENT DOCUMENTS 3,972,489 8/1976 Kovaleski ..... 242/128

*Primary Examiner*—Leonard D. Christian

*Attorney, Agent, or Firm*—Karl F. Ross

[57] ABSTRACT

A device for the axial uncoiling of wire from a spool in which the spool is axially carried on a support with a polished take-off ring rotatably mounted on the support adjacent the spool and engageable with the wire, a first array of radially disposed bristles also being rotatably mounted on the support and engageable with the wire, with a first braking element being connected with the take-off ring and a second braking element slidably mounted on the support and spaced from the first braking element during the uncoiling of the wire for enabling the take-off ring and the first array of bristles to be freely rotatable, with means for displacing the second braking element along the support for engagement with the first braking element only upon termination of the uncoiling of the wire.

6 Claims, 2 Drawing Figures

DEVICE FOR THE AXIAL UNCOILING OF WIRES

FIELD OF THE INVENTION

The present invention relates, in general, to the axial uncoiling of wires, and, more particularly, to a device for the axial uncoiling of wire from a spool.

BACKGROUND OF THE INVENTION

There are two basic methods of uncoiling a spool of wire: the tangential system whereby the wire is drawn off in a plane perpendicular to the axis of the spool, which is set up to pivot about its axis, and the axial system whereby the wire is drawn off from a point on the axis of the spool, which in this case is usually fixed in its support.

The axial uncoiling method is coming into wider and wider use, for two principal reasons. The first is a result of developments in cablemaking, in which spools of ever increasing size are being adopted, even for the finest of wires. Since the uncoiling speeds are being gradually raised, it is becoming more and more important to minimize the rotating masses.

The axial uncoiling method avoids this problem, in the sense that the spool is stationary. Within the uncoiling method, an arm is sometimes provided which pivots about the spool and is articulated about an axis corresponding to the spool axis. This arm, whose free extremity carries a roller to guide the wire, helps to prevent wire blockages, notably when the wire is level with the cheeks of the spool. The arm is kept rotating by the tension in the wire, but has the disadvantage of transmitting to the wire a higher tension than can be permitted at high uncoiling speeds.

One way of overcoming this disadvantage is to motorize the arm and regulate its speed as a function of the measured tension in each wire. Nevertheless, this is a costly expedient which is only acceptable for special applications.

For this reason it is becoming increasingly popular to dispense with the arm and draw the wire over a highly polished ring surrounding the spool cheek on the drawing side. This ring can be supplemented by a disc set with flexible radial bristles which hold the wire in check as it rotates round the ring.

Various systems can be used: a fixed ring and fixed-bristle disc; a spinning ring on a pivot coaxial with the spool axis and a fixed-bristle disc; or again a ring and bristled disc both spinning on a pivot coaxial with the spool axis.

To the extent that the ring can spin freely, it plays a role similar to that of the arm referred to previously in facilitating the uncoiling action. Nevertheless, if very high uncoiling speeds are sought, the tension is found to increase correspondingly and to vary during the process because as the end of the spool is approached, the speed at which the wire rotates is appreciably increased.

Finally, if the take-off machine suddenly stops, the ring continues to rotate and can take the wire with it, thereby causing loss of tension.

OBJECT OF THE INVENTION

It is an object of the present invention to overcome these disadvantages by providing a device which ensures the maintenance of a certain tension in the wire when in operation and the prevention of loss of tension when the uncoiling machine stops, for example in the case of wire breakage.

SUMMARY OF THE INVENTION

The device of the present invention is of the type having a support for the spool holding the wire to be uncoiled, a polished ring whose backing is disposed adjacent the spool cheek on the wire uncoiling side, a disc carrying radial bristles disposed adjacent to the ring backing on the side nearer the wire drawing point and an axle coaxial with the wire spool axis on which the two discs carrying the ring and the radial bristles respectively are free to rotate.

In conformity with the essential characteristics of the invention, this device also incorporates friction means which curb the rotary motion of the disc carrying the ring and the disc carrying the radial bristles when the drawing machine is halted.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
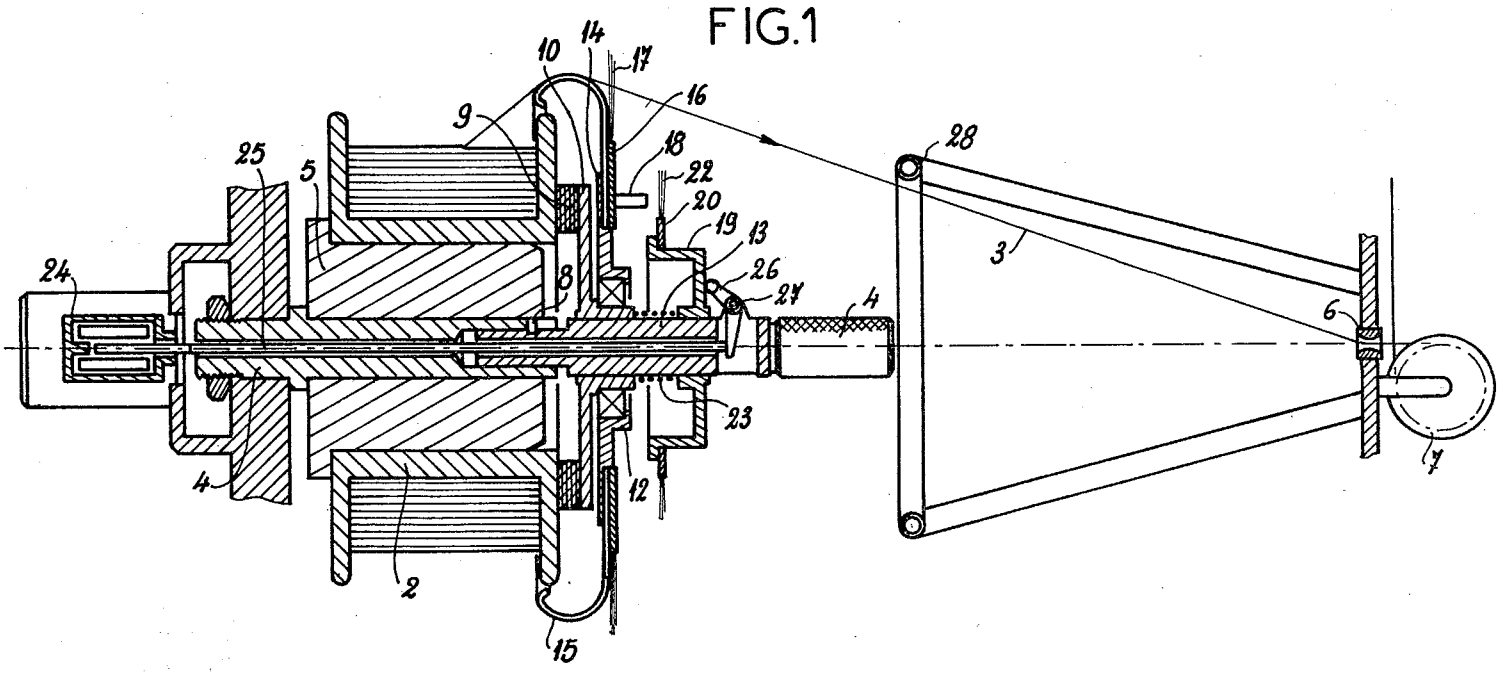
FIG. 1 is a longitudinal section of the device according to the invention in the uncoiling position.

The device shown in the drawing is more particularly intended for the uncoiling of fine wires from spools. The spool 2 on which the wire 3 is initially wound is mounted on a spindle 4 and is traversed by a central bore, in which is interposed an intermediate core 5. Between the spool 2 and the drawing point, of which only one wire guide 6 and one wire tension regulator 7 are shown, there is fitted a set of moving components journalled on an axle 13 which is fixed on the spindle 4 by means of a bayonet lock 8. This set comprises a resilient member 9 integral with a support member 10 adapted to bear on the spool cheek on the drawing machine side and thus to hold the spool in place. A component 12 mounted freely to rotate about the axle 13 carries a first disc 14 supporting a ring 15 whose free rim is disposed adjacent the spool cheek facing the uncoiling device and a second disc 16 having on its periphery radial bristles 17 which extend beyond the ring 15.

Projecting from its face directed towards the uncoiling point, the disc 16 has a set of fingers 18, one of which is shown in the drawing.

A hub 19 is mounted on the axle 13, unable to rotate but capable of sliding along the axle. This hub 19 carries a disc 20 on which are mounted radial bristles 22 disposed at some distance from the fingers 18 and intersecting the axis thereof. Under normal operating conditions, the hub 19 is held away from the disc 16 carrying the bristles 17 by means of a spring 23.

The device of the invention also incorporates, on the further side of the spool from the drawing point, a compression electromagnet 24 associated with a rod 25, the free end of which bears on an angled lever 26 hinged on a pivot 27 normal to the spool axis, the end of the lever 26 bearing on the hub 19 which carries the disc 20 and bristles 22. This electromagnet is energised by a circuit which is broken whenever the drawing machine is functioning.

On the structure that supports the spindle, and in line therewith, there is fixed a ring 28 which ensures that the centrifugal ballooning of the wire occurring at high speeds of rotation will not deflect it clear of the bristles 17 on the disc 16.

From the practical viewpoint, when a traction force is applied to the wire the bristles 17 on the disc 16 are deflected, thereby maintaining a certain tension in the wire and tending to entrain the ring 15 which is attached to this disc. As the drawing speed is increased, the ring and the disc also accelerate, without however attaining the exact speed of wire rotation around the spool, so that a frictional drag always persists in the disc bristles but does not increase with the speed, as is the case with a fixed disc.

The same applies when the speed of rotation increases because the diameter of the stock of wire on the spool is decreasing.

Figure 2:
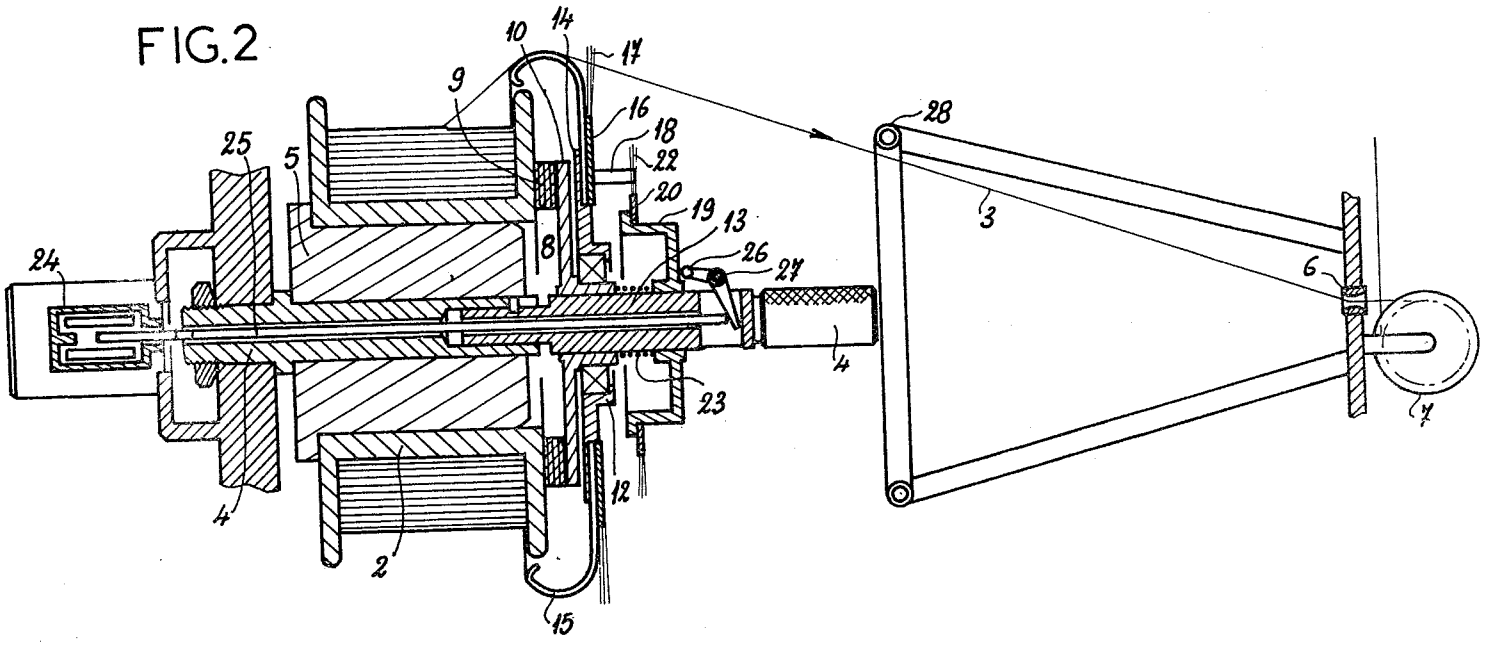
FIG. 2 is a longitudinal section in the halted position of the wire drawing device.

When the drawing machine is halted, the electromagnet 24 is energised throughout the halting period and pushes the rod 25 forwards, thereby pivoting the lever 26 and displacing the hub 19 against the action of the spring 23. The bristles 22 on the disc 20 come into contact with the fingers 18 on the disc 16, as shown in FIG. 2, thereby braking both it and the ring to prevent both loss of tension in, and unwinding of, wire.

The invention is obviously not limited to the single embodiment of the device described above by way of example; on the contrary, it includes all the practical variants.

Thus the device as described is particularly adapted to the uncoiling of fine wires, when the spool dimensions allow the use of equipment which can be fitted on the spindle as a single and easily manipulated unit, but by adopting a different arrangement comprising several units it is possible to adapt the same device to large spools and thick wires, both insulated and bare.

It is equally possible to provide a friction unit of a different type or an actuating device of a different type, such as an attraction electromagnet which could be disposed in front of the spindle instead of behind it as described above.

Whereas the spool is described as fixed, the entire device could be mounted on a rotating spindle to increase or reduce the wire torsion.

Since all the moving parts are balanced about their axes of rotation, the spindle axis can point in any direction, i.e., horizontal, vertical or inclined.

I claim:

1. A device for the axial uncoiling of wire from a spool comprising:

a support for axially carrying said spool;

a wire drawing point axially juxtaposed with said spool;

a polished take-off ring rotatably mounted on said support adjacent said spool between said spool and said wire drawing point and engageable with said wire;

a first array of radially disposed bristles rotatably mounted on said support between said ring and said wire drawing point and engageable with said wire;

a first braking element connected with said take-off ring;

a second braking element slidably mounted on said support and spaced from said first braking element during the uncoiling of said wire for enabling said take-off ring and said first array of bristles to be freely rotatable; and means for displacing said second braking element along said support for engagement with said first braking element only upon termination of the uncoiling of said wire.

2. The device defined in claim 1 wherein said take-off ring and said first array of bristles are connected together for common braking and rotation around said support.

3. A device for the axial uncoiling of wire from a spool comprising:

a support for axially carrying said spool;

a wire drawing point axially juxtaposed with said spool;

a polished take-off ring rotatably mounted on said support adjacent said spool between said spool and said wire drawing point and engageable with said wire;

a first array of radially disposed bristles mounted on said take-off ring between said ring and said wire drawing point and engageable with said wire;

a first braking element formed on said take-off ring;

a second braking element slidably mounted on said support and spaced from said first braking element during the uncoiling of said wire for enabling the free rotation of said take-off ring; and means for displacing said second braking element along said support for engaging and disengaging said first braking element, said first braking element comprising at least one finger mounted on said take-off ring offset from the axis thereof and projecting toward said second braking element, and said second braking element comprising a second array of radially disposed bristles, said second array being displaceable to engage said finger in response to the termination of the uncoiling of said wire.

4. The device defined in claim 3 wherein said displacing means comprises an electromagnet and at least one spring acting on said second array in opposite directions.

5. The device defined in claim 4 wherein said spring is disposed between said take-off ring and said second array to displace said second array out of engagement with said finger when said uncoiling device is in operation, said electromagnet acting to displace said second array into engagement with said finger against the force of said spring when said electromagnet is energized.

6. The device defined in claim 5, further comprising:

a lever mounted on said support between said second array and said wire drawing point, one end of said lever being in engagement with said second array;

a throughgoing bore formed in said support; and a rod extending through said bore and having a first end engaging the other end of said lever and a second end engaged by said electromagnet, said electromagnet being disposed on the other side of said spool facing away from said wire drawing point and acting on said rod to displace same to pivot said lever for displacing said second array into engagement with said finger when said electromagnet is energized.

* * * * *